United States Patent [19]

Acuncius et al.

[11] 4,043,810

[45] Aug. 23, 1977

[54] CAST THERMALLY STABLE HIGH TEMPERATURE NICKEL-BASE ALLOYS AND CASTING MADE THEREFROM

[75] Inventors: Dennis A. Acuncius; Robert B. Herchenroeder, both of Kokomo; Russell W. Kirchner, Greentown; William L. Silence, Kokomo, all of Ind.

[73] Assignee: Cabot Corporation, Kokomo, Ind.

[21] Appl. No.: 644,430

[22] Filed: Dec. 29, 1975

Related U.S. Application Data

[63] Continuation-in-part of Ser. No. 179,922, Sept. 13, 1971.

[51] Int. Cl.[2] ..... C22C 19/05

[52] U.S. Cl. ..... 75/171; 148/32.5; 148/162

[58] Field of Search ..... 75/171, 170; 148/32, 148/32.5, 162

[56] References Cited

U.S. PATENT DOCUMENTS

| | | | |
|---|---|---|---|
| 2,067,569 | 1/1937 | Hessenbruch | 75/171 |
| 3,203,792 | 8/1965 | Scheil et al. | 75/171 |
| 3,304,176 | 2/1967 | Wlodek | 75/171 |

*Primary Examiner*—R. Dean

*Attorney, Agent, or Firm*—Jack Schuman; Joseph J. Phillips

[57] ABSTRACT

A cast thermally stable high temperature nickel-base alloy characterized by superior oxidation resistance, sustainable hot strength and retention of ductility on aging is provided by maintaining the alloy chemistry within the composition molybdenum 13.7% to 15.5%; chromium 14.7% to 16.5%; carbon up to 0.1%, lanthanum in an effective amount to provide oxidation resistance up to 0.08%; boron up to 0.015%; manganese 0.3% to 1.0%; silicon 0.2% to 0.8; cobalt up to 2.0%; iron up to 3.0%; tungsten up to 1.0%; copper up to 0.4%; phosphorous up to 0.02%; sulfur up to 0.015%; aluminum 0.1% to 0.5% and the balance nickel while maintaining the Nv number less than 2.31.

6 Claims, 14 Drawing Figures

CAST THERMALLY STABLE HIGH TEMPERATURE NICKEL-BASE ALLOYS AND CASTING MADE THEREFROM

This application is a continuation-in-part of our copending application, Ser. No. 179,922, filed Sept. 13, 1971.

The present application is directed to cast thermally stable high temperature nickel-base alloys and castings made therefrom and more particularly to an essentially non-ferrous, solid solution type nickel-base alloy of the Ni-Cr-Mo class which possesses high thermal stability, high thermal strength, oxidation resistance, low thermal expansion and high retention of ductility on aging.

As we have pointed out in our parent application, great emphasis has been placed in recent years, in the field of solid solution strengthened nickel-base alloys, on attempts to provide improved structural material for use in equipment exposed to various high temperature conditions on the order of about 1500° F. and above. The field of jet engine manufacture is but one of the fields where there is and has been a continuing push to higher operating temperature levels in order to attain higher performance characteristics. For example the very sizable increases in power and efficiency which can be obtained from a typical gas turbine by an increase in operating temperature from 1500° F. to 1600° F. is pointed out by Sims and Beltran in U.S. Pat. No. 3,549,356.

The primary emphasis has been essentially in the field of wrought alloys, however, the same problems and needs have existed in the field of cast alloys. The problems of the cast alloy field have, however, also included the problem of avoiding loss of ductility on aging particularly in those alloys subject to high temperature.

Thus, although many approaches have been tried in an effort to improve nickel-base alloys with regard to service life at temperatures in the range of 1600° F. and above, the ultimate goal of a combination of superior oxidation (corrosion) resistance, sustainable hot strength, low thermal expansion and retention of ductility on aging has eluded the art.

We have discovered a cast alloy and castings made therefrom which do for the first time attain all of these objectives. We have found that these objectives can be obtained by simultaneously controlling the composition of the alloy within certain limits while controlling the electron vacancy (Nv) number.

We have discovered that, for castings which are characterized by superior oxidation resistance, sustainable high hot strength, low thermal expansion and retention of ductility on aging, the following broad composition may be employed:

| | |
|---|---|
| Mo | 13.7% to 15.5% |
| Cr | 14.7% to 16.5% |
| C | Up to 0.1% |
| La | An effect. amt. to 0.08% |
| B | Up to 0.015% |
| Mn | 0.3% to 1.0% |
| Si | 0.2% to 0.8% |
| Co | Up to 2.0% |
| Fe | Up to 3.0% |
| W | Up to 1.0% |
| Cu | Up to 0.4% |
| P | Up to 0.02% |
| S | Up to 0.015% |
| Al | 0.1% to 0.5% |
| Ni + incidental impurities | Balance |

-continued

Said alloy having an Nv number less than 2.31

The preferred composition which provides the greatest thermal stability is:

| | |
|---|---|
| Mo | 13.7% to 15.5% |
| Cr | 14.7% to 16.5% |
| C | Up to .02% |
| La | An effect. amt. to 0.08% |
| B | Up to 0.015% |
| Mn | 0.3% to 1.0% |
| Si | 0.2% to 0.8% |
| Co | Up to 2.0% |
| Fe | Up to 3.0% |
| W | Up to 1.0% |
| Cu | Up to 0.4% |
| P | Up to 0.02% |
| S | Up to 0.015% |
| Al | 0.1% to 0.5% |
| Ni + incidental impurities | Balance |

We have found that carbon above 0.02% provides greater strength but at the cost of reduced thermal stability and prefer to stay below 0.02% carbon for most applications.

| The specific composition which we prefer is: | |
|---|---|
| Mo | 14.0% |
| Cr | 15.5% |
| C | LAP (lowest amt. possible) |
| La | 0.04% |
| B | 0.01% |
| Mn | 0.5% |
| Si | 0.4% |
| Co | LAP |
| Fe | LAP |
| W | LAP |
| Cu | LAP |
| P | LAP |
| S | LAP |
| Al | 0.25% |
| Ni + incidental impurities | Balance |

Said alloy having an Nv number as close to 2.28 as possible but within the range 2.23 and 2.31.

In connection with the various tests, certain drawings have been prepared and form a part of this application as follows.

Figure 1A:
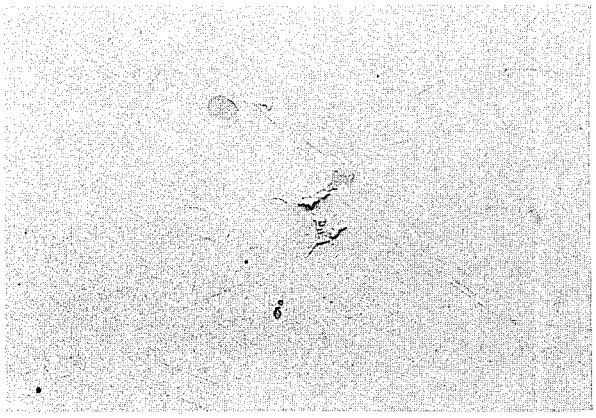
FIGS. 1A - 1C are photomicrographs showing the morphology of the nickel-lanthanum intermetallic compound.

The unique properties of this casting alloy and of castings produced therefrom can best be recognized by the following examples.

EXAMPLE I

Seven 20-pound castings were poured in vacuum with lanthanum content being adjusted by adding nickel-lanthanum master alloy as late additions to the crucible just prior to pouring the seven castings. The chemical analyses of the seven castings appear in Table I.

TABLE I

CHEMICAL ANALYSIS OF CASTINGS

| Element | Mold #1 | Mold #2 | Mold #3 | Mold #4 | Mold #5 | Mold #6 | Mold #7 |
|---|---|---|---|---|---|---|---|
| Ni | Bal. | Bal. | Bal. | Bal. | Bal. | Bal. | Bal. |
| Cr | 15.5 | 15.67 | 15.57 | 15.62 | 15.62 | 15.50 | 15.62 |
| Mo | 14.14 | 14.19 | 14.13 | 14.18 | 14.40 | 14.13 | 14.00 |
| Al | .17 | .18 | .18 | .18 | .17 | .17 | .18 |
| B | .014 | .015 | .014 | .016 | .017 | .016 | .015 |
| Co | .01 | .01 | .01 | .01 | .02 | .02 | .02 |
| Cu | .01 | .01 | .01 | .01 | .01 | .01 | .01 |
| Fe | .10 | .10 | .10 | .10 | .10 | .10 | .10 |
| Mg | .01 | .01 | .01 | .01 | .01 | .01 | .01 |
| Mn | .43 | .45 | .44 | .46 | .45 | .45 | .48 |
| P | .005 | .005 | .005 | .005 | .005 | .005 | .005 |
| S | .01 | .009 | .006 | .006 | .01 | .011 | .01 |
| Si | .33 | .35 | .34 | .38 | .38 | .39 | .39 |
| Ti | .01 | .01 | .01 | .01 | .01 | .01 | .01 |
| W | .10 | .10 | .10 | .10 | .10 | .10 | .10 |
| C | .003 | .002 | .004 | .004 | .005 | .003 | .005 |
| La | <.01 (none) | .01 | .011 | .021 | .038 | .055 | .064 |

Each casting produced 10, ½-inch diameter pins approximately 4 inches long from which were machined tensile test bars. Samples from each heat were subjected to metallographic examination and to tensile testing at room temperature, 1400° and 1800° F., in addition to stress rupture testing at 1400° F. at a stress of 25,000 psi. Also, two samples from each mold were tensile tested at room temperature after aging at 1000 hours at 1600° F. Appropriate specimens were also machined from the gating system of each mold and subjected to environmental testing as follows:

Static Oxidation

Exposed to dry flowing air (36 cfh/in$^2$ of furnace cross section) at 1600° F. for 500 hours.

Dynamic Oxidation

Exposed to about 0.3 Mach velocity combustion gases (No. 2 fuel oil) at 1600° F. (and 1800° F.) for 300 hours. Specimens were cycled out of the hot zone and fan cooled to about 300° F. every 30 minutes.

Hot Corrosion

Exposed to low velocity (13 ft. per sec.) combustion gases (No. 2 fuel oil) and injected sea salt (5 ppm of gas) 1650° F. for 200 hours. Specimens were cycled out of the hot zone every 60 minutes and fan cooled to less than 300° F.

Figure 1B:
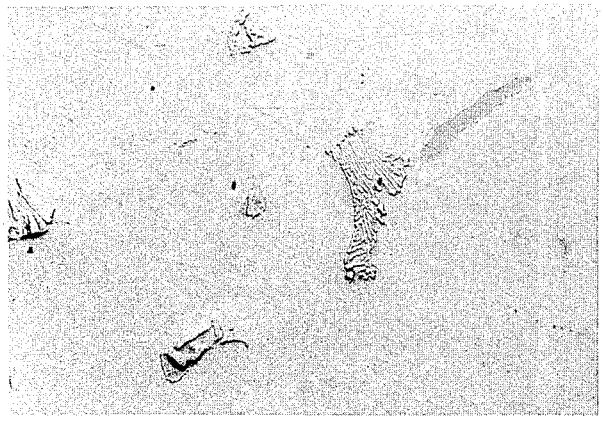
Figure 1C:
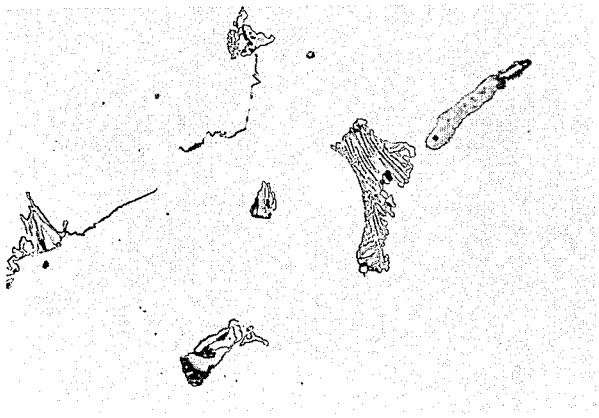

Metallographic examination of the seven castings containing variable lanthanum concentrations revealed a variety of sparsely distributed non-metallic inclusions; among them carbides, oxides and nitrides. The presence of rounded nickel-lanthanum intermetallic compounds as identified by microprobe analyses was also observed but only in those heats whose lanthanum concentration was 0.038% or higher, suggesting the maximum solid solubility of lanthanum in a nickel-chromium-molybdenum matrix is about 0.04%. The morphology of the nickel lanthanum intermetallic is shown in FIG. 1. It can best be seen on an as polished surface under a plain light source with no filter. Under these conditions, the compound appears a greenish gray. The compound is highly unstable and will decompose if the sample is chemically etched.

Figure 2:
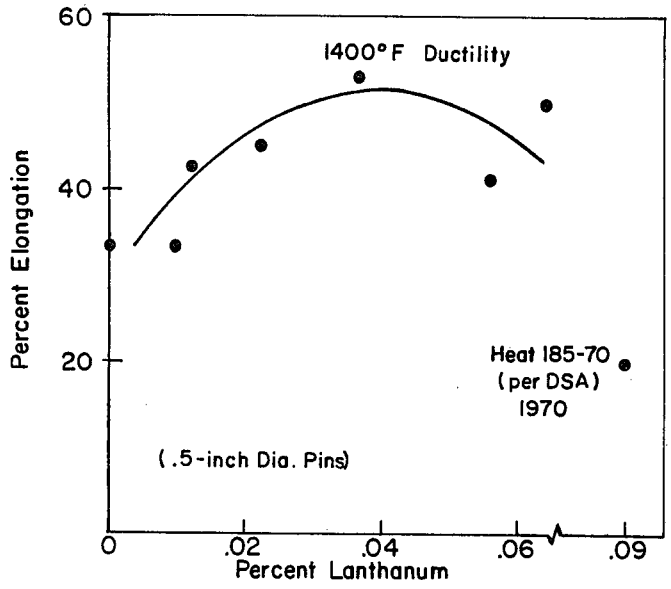
FIG. 2 is a graph of lanthanum vs. elongation.

Table II, below, summarizes the mechanical properties of the variable lanthanum heats. As expected, all heats experienced excellent retention of ductility after aging for 1000 hours at 1600° F. The most noticeable influence of lanthanum variations on mechanical properties was on the elevated temperature ductility. These data are presented graphically in FIG. 2 and suggest an optimization in elevated temperature ductility at a lanthanum concentration of 0.02% and above within the range examined.

TABLE II

Summary of Mechanical PROPERTIES (VARIABLE La CASTINGS) DATA REPORTED IN AN AVERAGE OF TWO TESTS

| Property | Casting Number and La Concentration #1 None | #2 .01 | #3 .011 | #4 .021 | #5 .038 | #6 .055 | #7 .064 |
|---|---|---|---|---|---|---|---|
| RT Y.S. (ksi) | 36 | 35 | 35 | 36 | 36 | 36 | 36 |
| U.T.S. (ksi) | 82 | 78 | 78 | 81 | 83 | 82 | 80 |
| %E | 62 | 56 | 53 | 58 | 64 | 60 | 57 |
| %RA | 51 | 48 | 43 | 42 | 41 | 43 | 51 |
| RT* Y.S. (ksi) | 35 | 36 | 37 | 34 | 35 | 35 | 35 |
| U.T.S. (ksi) | 76 | 68 | 79 | 75 | 78 | 74 | 81 |
| %E | 42 | 30 | 40 | 41 | 44 | 37 | 45 |
| %RA | 33 | 38 | 37 | 30 | 35 | 21 | 41 |
| 1400° F. Y.S. | 20 | 19 | 20 | — | 21 | 21 | 21 |
| (ksi) | 40 | 39 | 44 | 45 | 45 | 43 | 46 |
| U.T.S. (ksi) | 33 | 33 | 42 | 45 | 53 | 41 | 51 |
| %E | 37 | 31 | 36 | 46 | 64 | 52 | 57 |
| %RA | | | | | | | |
| 1800° F. Y.S. | 17 | 14 | 18 | 17 | 16 | 15 | 16 |
| (ksi) | 20 | 19 | 20 | 19 | 20 | 20 | 18 |
| U.T.S. (ksi) | 28 | 27 | 32 | 47 | 37 | 54 | 41 |
| %E | 37 | 39 | 36 | 70 | 58 | 52 | 57 |
| %RA | | | | | | | |
| 1400° F/25 ksi stress rupture life (hours) | 34 | — | 21 | 40 | 35 | 35 | 29 |

*After aging at 1600° F. for 1000 hours

Table III summarizes the environmental resistance of the variable lanthanum heats. The dynamic oxidation resistance of the best heats (those exhibiting the lowest amount of metal loss and subscale oxide penetration) seemed to occur around lanthanum concentrations of 0.04 to 0.05% for those tested at 1800° F. The minimum static oxidation attack also seemed to occur at the same level. When adding $M_L$ metal loss and $D_S$ depth of oxide penetration in the hot corrosion data i.e. total effected metal, it is evident that the optimum level appears at about 0.01 and 0.02% of lanthanum.

TABLE III

ENVIRONMENTAL RESISTANCE OF VARIABLE LANTHANUM VACUUM CASTINGS

| Type Test | Test Temp. ° F. | Time Hrs. | Value | Casting and Lanthanum Concentration, Weight Percent #1 None | #2 .01 | #3 .011 | #4 .021 | #5 .038 | #6 .055 | #7 .064 |
|---|---|---|---|---|---|---|---|---|---|---|
| Static | 1600 | 500 | $M_L$ (1) | .08 | .08 | .08 | .07 | .06 | .06 | .06 |
| " | " | " | $D_S$ (2) | 1.25 | 1.15 | 1.10 | .95 | .63 | .60 | .95 |
| Dynamic | 1600 | 300 | $M_L$ (3) | 2.15 | 2.20* | 3.80* | 2.40* | 1.8* | 3.15 | 2.2 |
| " | " | " | $D_S$ | 1.07 | 1.28* | .87* | .94* | .96* | 1.13 | 1.0* |
| Dynamic | 1800 | 300 | $M_L$ (3) | 3.43 | 3.3* | 3.08 | 3.55* | 3.0* | 3.25* | 3.68 |
| " | " | " | $D_S$ | 1.49 | 1.36* | .94 | .76* | .82* | .70* | 1.17 |
| Hot | 1650 | 200 | $M_L$ (3) | 6.30 | 3.3* | 2.20 | 2.85 | 6.45 | 9.40* | 6.83 |
| Corrosion | | | $D_S$ | 6.04 | 5.29* | 6.33 | 4.47 | 10.6 | 7.87* | 8.71 |

NOTES:
(1) $M_L$ is the metal loss in mils per side as determined by weight change after descaling.
(2) $D_S$ is the depth of continuous oxide penetration in mils below the descaled surface ofthe specimen (determined metallographically)
(3) $M_L$ is the metal loss in mils per surface (determined by change in diameter of the specimen).
*One test only

EXAMPLE II

Five 120-pound raw material master heats were vacuum melted, each with a slightly increasing level of chromium and molybdenum. A chemical composition of these heats is given in Table IV along with the electron vacancy (Nv) number, as calculated by a computer program as described in U.S. Ser. No. 179,922. The Nv numbers ranged between 2.19 and 2.34. Each heat was used to vacuum cast a mold which produced several test pins ranging in diameter from 0.299 inch up to 0.980 inch from which specimens were obtained for tensile property determinations at room temperature, 1400° F. and 1800° F. in addition to stress rupture testing at 1400° F. under a load of 20,000 psi. Two similar molds were vacuum cast from each heat and some pins from each mold were aged at 1600° F. for 1000 hours. A few pins from each mold were given a 2400° F., 24-hour vacuum homogenization heat-treatment prior to aging. Since the soldification time, and the coarseness of the solidification structure, varied directly with test pin diameter, it was possible to study the influence of cast segregation on aged ductility.

TABLE IV

CHEMICAL ANALYSIS OF VARIABLE Nv VACUUM CASTINGS

| Element | A | B | C | D | E |
|---|---|---|---|---|---|
| Ni | 68.93 | 68.38 | 67.88 | 67.30 | 66.94 |
| Cr | 15.14 | 15.49 | 15.58 | 15.94 | 16.07 |
| Mo | 13.14 | 13.66 | 13.86 | 14.32 | 14.68 |
| Al | .27 | .26 | .27 | .26 | .27 |

TABLE IV-continued

CHEMICAL ANALYSIS OF VARIABLE Nv VACUUM CASTINGS

| Element | A | B | C | D | E |
|---|---|---|---|---|---|
| B | .007 | .006 | .007 | .006 | .006 |
| Co | .28 | .23 | .22 | .22 | .22 |
| Cu | <.01 | <.01 | .01 | .01 | .01 |
| Fe | .88 | .82 | .82 | .82 | .82 |
| Mg | <.01 | <.01 | <.01 | .01 | .01 |
| Mn | .49 | .49 | .52 | .51 | .52 |
| P | .005 | .005 | <.005 | .005 | .005 |
| S | .005 | .005 | <.005 | .005 | .005 |
| Si | .30 | .27 | .37 | .37 | .39 |
| Ti | <.01 | <.01 | .01 | .01 | .01 |
| W | <.01 | <.10 | .10 | .10 | .10 |
| C | .01 | .002 | .01 | .01 | .01 |
| La | .058 | .045 | .034 | .048 | .024 |
| Nv | 2.19 | 2.23 | 2.26 | 2.31 | 2.34 |

Figure 3:
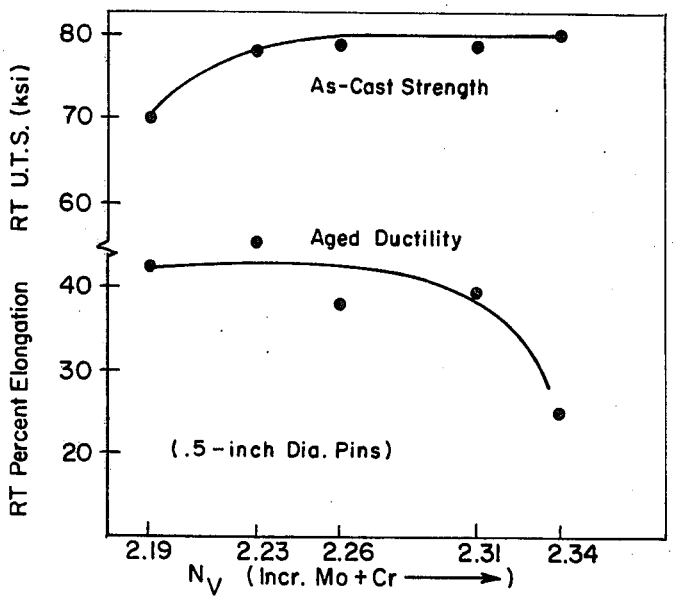
FIG. 3 is a graph showing the influence of variable Nv on as cast and aged properties.

Table V summarizes the mechanical properties of the variable Nv heats of Example II. The data represent values associated with ½-inch diameter cast pins. A portion of the data is presented graphically in FIG. 3. The limiting factor at the low end of the Nv number range is the as-cast room temperature ultimate strength and 1400° F. stress rupture life which falls noticeably at values of less than 2.23. The limiting factor at the high end of the Nv range is ductility after aging which falls noticeably for Nv values greater than 2.31. From this, one finds that an optimum Nv range lies between 2.23 and 2.31.

TABLE V

SUMMARY OF MECHANICAL PROPERTIES VARIABLE Nv VACCUM CATINGS
(Data reported are average of two tests)

| Property | Heat A Nv 2.19 | Heat B Nv 2.23 | Heat C Nv 2.26 | Heat D Nv 2.31 | Heat E Nv 2.34 |
|---|---|---|---|---|---|
| R.T. Yield (ksi) | 31 | 34 | 33 | 33 | 34 |
| Ultimate (ksi) | 69 | 78 | 78 | 77 | 79 |
| %E | 51 | 68 | 61 | 62 | 64 |
| %RA | 43 | 64 | 48 | 50 | 47 |
| R.T. Yield (ksi)* | 34 | 35 | 37 | 37 | 40 |
| Ultimate (ksi) | 78 | 81 | 81 | 84 | 80 |
| %E | 42 | 46 | 36 | 39 | 23 |
| %RA | 42 | 33 | 28 | 36 | 22 |
| 1400° F. Yield (ksi) | 18 | 19 | 20 | 20 | 20 |
| Ultimate (ksi) | 41 | 40 | 42 | 42 | 42 |
| %E | 45 | 52 | 54 | 51 | 49 |
| %RA | 58 | 68 | 57 | 60 | 57 |
| 1800° F. Yield (ksi) | — | 14 | 10 | 10 | 12 |
| Ultimate (ksi) | — | 19 | 16 | 16 | 17 |
| %E | — | 39 | 45 | 42 | 44 |
| %RA | — | 70 | 46 | 48 | 65 |
| 1400° F./20 ksi Stress Rupture Life (hours) | 86 | 144 | 130 | 115 | 108 |

*Aged 1600° F. for 1000 hours

Figure 4:
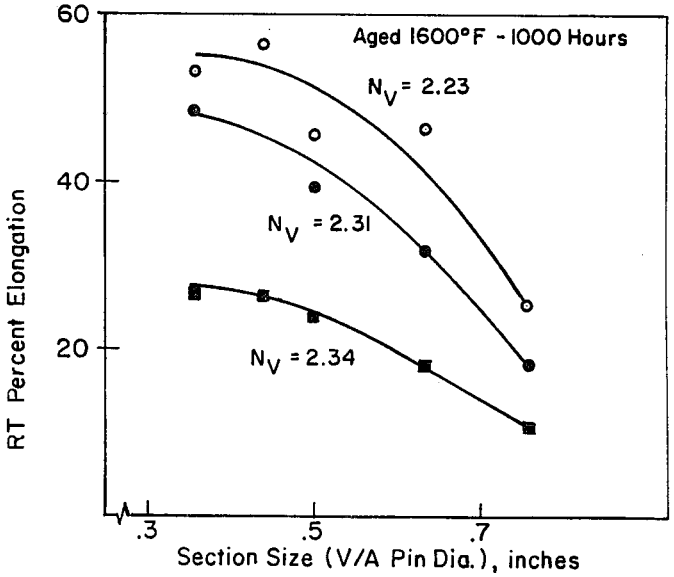
FIG. 4 is a graph showing the influence of section size on aged ductility.
Figure 5A:
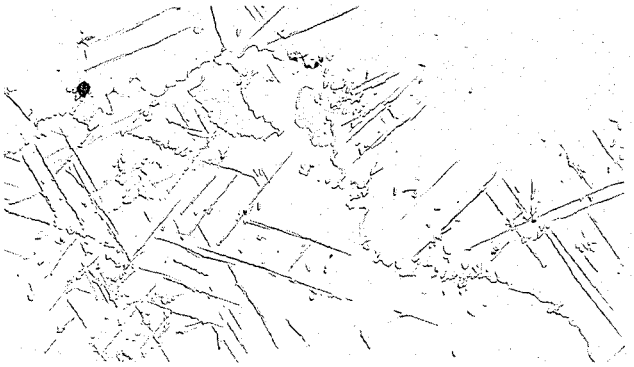
FIGS. 5A - 5D are micrographs of castings after aging at 1600° F. for 1000 hours.
Figure 5B:
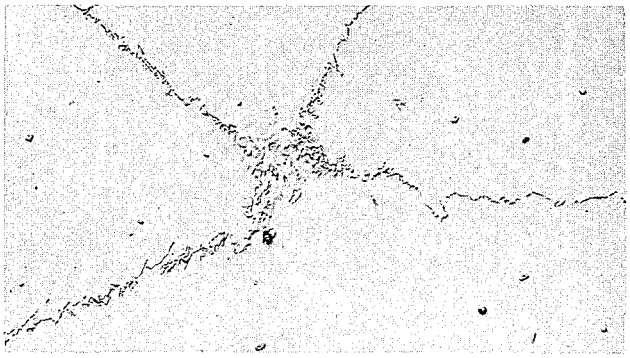
Figure 5C:
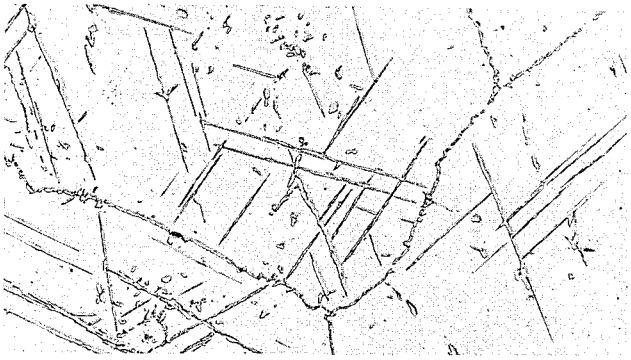
Figure 5D:
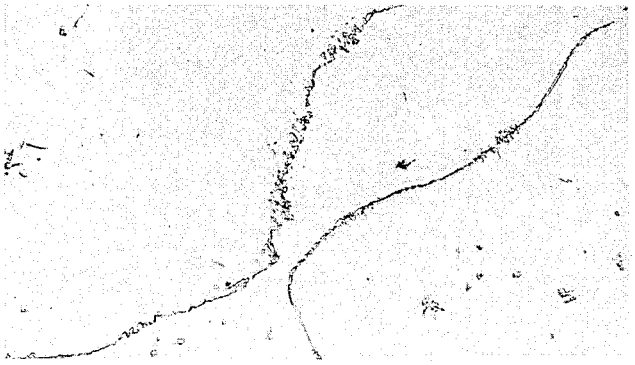
Figure 6A:
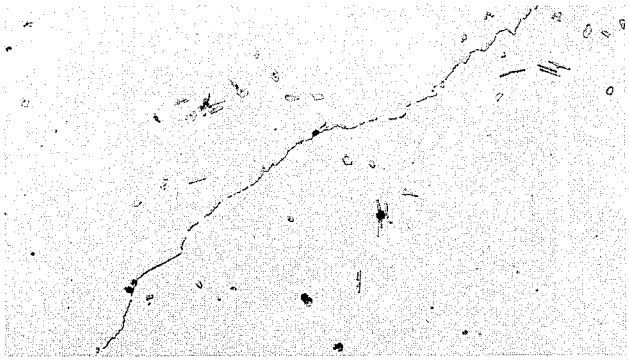
FIGS. 6A - 6D are micrographs of castings after aging 1600° F. for 1000 hours.
Figure 6B:
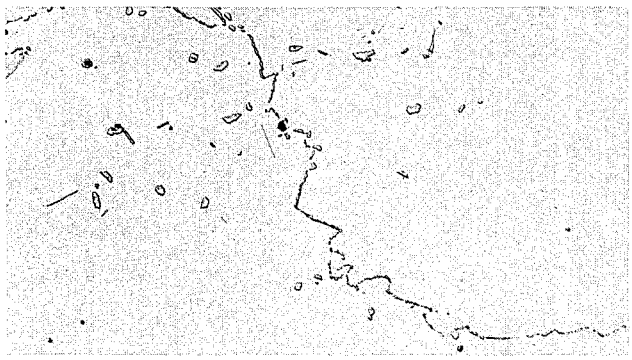
Figure 6C:
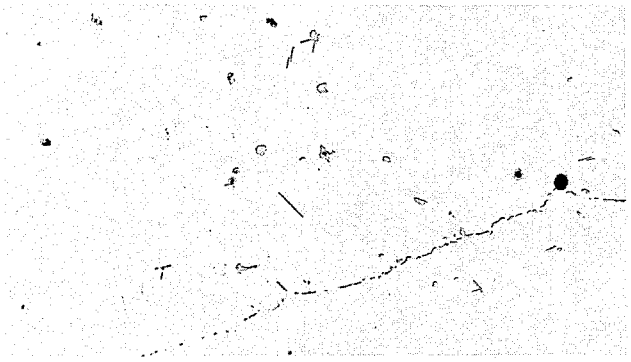
Figure 6D:
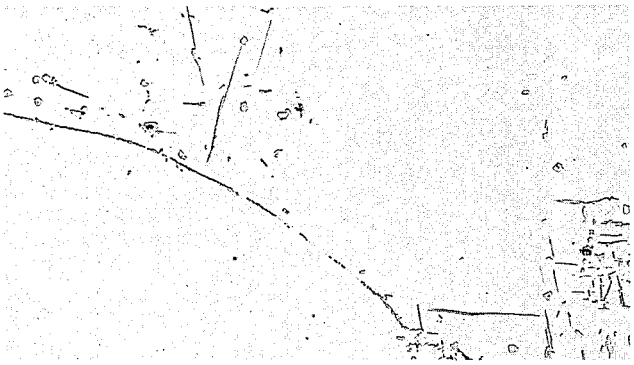

The influence of Nv variation on aged ductility can be examined further by considering the data documented in Table VI, generated on pins of variable diameters. Portions of this data are shown graphically in FIG. 4 as a plot of aged ductility versus pin diameter. It should be noted that the larger the section size the coarser the solidification structure, hence the greater the segregation of intermetallic forming elements such as molybdenum and chromium. FIG. 4 shows explicitly that aged ductility decreases with increasing section size. Thus, two factors can work simultaneously to decrease aged ductility of cast alloys of this type: (1) Chemistry (high Nv number) and (2) segregation (thick sections and long solidification time).

TABLE VI

ROOM TEMPERATURE TENSILE DATE FOR CAST ALLOY (Aged 1600° F. for 1000 Hours)

| Heat I.D. (1) | Nv | V/A Pin Diam. (2) (Inches) | Yield (psi) | Ultimate (psi) | %E | %RA |
|---|---|---|---|---|---|---|
| A* | 2.19 | .750 | 31,400 | 58,800 | 23.7 | 18.3 |
| A* | 2.19 | .625 | 32,000 | 69,300 | 31.7 | 20.1 |
| A* | 2.19 | .500 | 31,900 | 75,800 | 42.0 | 30.8 |
| A* | 2.19 | .435 | 32,300 | 69,000 | 38.0 | 26.6 |
| A* | 2.19 | .355 | 32,200 | 74,600 | 40.2 | 31.8 |
| A | 2.19 | .750 | 31,900 | 65,400 | 30.7 | 28.7 |
| A | 2.19 | .750 | 32,400 | 62,700 | 31.4 | 33.4 |
| A | 2.19 | .625 | 33,200 | 82,300 | 51.3 | 46.4 |
| A | 2.19 | .500 | 34,100 | 73,500 | 33.9 | 36.8 |
| A | 2.19 | .500 | 33,900 | 81,700 | 50.4 | 43.5 |
| A | 2.19 | .435 | 33,800 | 79,300 | 44.6 | 39.3 |
| A | 2.19 | .355 | 34,000 | 84,200 | 50.2 | 31.8 |
| A | 2.19 | .299 | 34,600 | 77,900 | 35.3 | 26.9 |
| B* | 2.23 | .625 | 31,700 | 69,700 | 41.3 | 39.7 |
| B* | 2.23 | .500 | 31,500 | 80,900 | 59.4 | 43.5 |
| B* | 2.23 | .435 | 32,300 | 77,200 | 52.8 | 19.4 |
| B* | 2.23 | .355 | 32,000 | 81,800 | 58.4 | 39.8 |
| B | 2.23 | .980 | 28,000 | 34,200 | 10.6 | 9.4 |
| B | 2.23 | .750 | 33,400 | 59,800 | 24.6 | 22.6 |
| B | 2.23 | .625 | 35,000 | 80,900 | 48.1 | 32.9 |
| B | 2.23 | .500 | 34,800 | 80,300 | 48.4 | 36.8 |
| B | 2.23 | .500 | 35,100 | 82,100 | 44.5 | 29.6 |
| B | 2.23 | .435 | 33,900 | 83,500 | 57.6 | 37.5 |
| B | 2.23 | .355 | 35,200 | 86,600 | 52.1 | 30.8 |
| B | 2.23 | .299 | 36,100 | 81,900 | 40.1 | 26.1 |
| C* | 2.26 | .750 | 32,500 | 66,800 | 30.5 | 27.5 |
| C* | 2.26 | .625 | 33,300 | 69,500 | 33.8 | 26.9 |
| C* | 2.26 | .500 | 33,800 | 73,500 | 37.4 | 24.0 |
| C* | 2.26 | .435 | 33,600 | 74,100 | 41.2 | 33.1 |
| C* | 2.26 | .355 | 32,800 | 71,400 | 38.2 | 38.8 |
| C | 2.26 | .750 | 36,200 | 75,300 | 35.8 | 24.6 |
| C | 2.26 | .625 | 36,000 | 74,600 | 31.0 | 27.5 |
| C | 2.26 | .500 | 36,000 | 82,300 | 39.0 | 27.5 |
| C | 2.26 | .500 | 37,100 | 79,000 | 32.9 | 27.5 |
| C | 2.26 | .435 | 37,100 | 83,300 | 39.5 | 29.5 |
| C | 2.26 | .355 | 35,700 | 85,400 | 49.5 | 34.8 |
| C | 2.26 | 2.99 | 38,600 | 87,700 | 44.2 | 30.8 |
| D* | 2.31 | .750 | 33,400 | 70,900 | 34.2 | 29.0 |
| D* | 2.31 | .625 | 33,500 | 74,000 | 36.3 | 29.0 |
| D* | 2.31 | .500 | 33,900 | 75,900 | 40.5 | 31.6 |
| D* | 2.31 | .435 | 34,000 | 77,500 | 46.9 | 33.1 |
| D* | 2.31 | .355 | 33,800 | 79,900 | 47.0 | 25.4 |
| D | 2.31 | .750 | 35,400 | 65,300 | 21.5 | 18.3 |
| D | 2.31 | .750 | 36,000 | 64,400 | 19.7 | 20.4 |
| D | 2.31 | .625 | 36,700 | 78,400 | 32.8 | 27.5 |
| D | 2.31 | .500 | 36,800 | 84,600 | 39.4 | 34.3 |
| D | 2.31 | .500 | 36,900 | 84,100 | 39.4 | 38.0 |
| D | 2.31 | .355 | 37,600 | 87,000 | 50.6 | 34.8 |
| D | 2.31 | .299 | 37,000 | 85,100 | 83.0 | 31.8 |
| E* | 2.34 | .980 | 33,500 | 53,000 | 14.1 | 15.4 |
| E* | 2.34 | .750 | 35,000 | 56,900 | 15.8 | 18.9 |
| E* | 2.34 | .625 | 36,700 | 65,500 | 18.3 | 16.9 |
| E* | 2.34 | .500 | 35,400 | 73,800 | 34.4 | 26.1 |
| E* | 2.34 | .435 | 34,400 | 72,500 | 37.0 | 29.5 |
| E* | 2.34 | .355 | 35,400 | 75,500 | 36.6 | 27.9 |
| E | 2.34 | .750 | 38,700 | 58,600 | 11.1 | 7.9 |
| E | 2.34 | .750 | 36,700 | 61,800 | 13.1 | 22.6 |
| E | 2.34 | .625 | 39,400 | 75,200 | 18.2 | 19.8 |
| E | 2.34 | .500 | 39,600 | 80,600 | 22.9 | 18.9 |
| E | 2.34 | .500 | 39,800 | 80,300 | 23.7 | 24.6 |
| E | 2.34 | .435 | 39,600 | 85,600 | 27.9 | 24.0 |
| E | 2.34 | .355 | 40,000 | 85,200 | 26.7 | 22.4 |
| E | 2.34 | .299 | 40,600 | 81,600 | 24.2 | 21.4 |

Notes:
(1) Specimens marked with asterisk were given a 2200° F./24 hour homogenization treatment prior to aging.
(2) .980, .750, .625 and .500 inch pins were machined to.250 inch gauge diameter. .435 inch pins were machinedto .187 inch gauge diameter. .355 and .299 inch pins weremachined to .160 inch gauge length.

An attempt to homogenize and hence improve aged ductility was met with limited success. Examination of the data presented in Table VI shows some improvement in aged ductility especially for the larger pin diameters. Microstructural features of 0.980 inch diameter aged cast alloy (Heats D and E) versus the same materials given the homogenization heat treatment prior to aging is shown in FIG. 5. Identity of phases extracted from Heat D in both of the aforementioned conditions is shown in Table VII. Both the metallographic and X-ray evidence reveal that a 2200° F./24 hour homogenization heat treatment is apparently capable of reducing or eliminating the needle-like Mu phase precipitation during aging. (Electron microprobe analysis of the needle phase revealed high concentration of molybdenum.) The reason for the somewhat low ductility (14% elongation for Heat E) in the homogenized and aged condition is probably related to the semi-continuous grain boundary film visible in FIG. 5. Table VII suggests that this film might be a carbide or boride phase. Despite slight improvements in age ductility of heavy sections, the use of a 2200° F./24 hour homogenization heat treatment is not recommended because of the added expense of this operation. It seems more feasible to minimize the Mu phase precipitation by controlling chemistry and by minimizing as-cast segregation.

The microstructure of aged cast alloys in thinner diameters (having less segregation) is shown in FIG. 6. The amount of needle-like Mu phase is greatly reduced compared to the amount visible in the 0.980-inch diameter pins.

TABLE VII

X-RAY IDENTIFICATION OF PHASES EXTRACTED FROM AGED (1600° F./1000 Hours) CAST ALLOYS (HEAT D - Nv 2.31) (.980 INCH DIAMETER PINS)

| Phase Type | Lattice Parameter | Relative Intensity: As Cast + Aged | Relative Intensity: Homogenized (2200° F./24 hrs) + Aged |
|---|---|---|---|
| FCC matrix | $a_o = 3.59$ | Weak | Strong |
| $M_6C$ | $a_o = 10.86$ | Very weak | Moderately strong |
| $M_3B_2$ | $a_o = 5.79$ $C = 3.11$ | Strong | Strong |
| Mu phase | | Moderately strong | None present |

From the foregoing data, it is evident that segregation, especially in heavy section thicknesses greater than ¾ inch, is a significant contributor to ductility degradation after long time aging. An homogenization treatment can, to some extent, minimize Mu phase precipitation. It is not a satisfactory answer because of the expense involved and because it cannot be a permanent solution. A permanent solution, as these data show, is the control of the composition to provide the critical Nv range here disclosed.

EXAMPLE III

Three alloys within this invention were melted with carbon contents of 0.004, 0.02 and 0.06%. Their nominal compositions were as set out in Table VIII.

TABLE VIII

| | Alloy 101 | Alloy 102 | Alloy 103 |
|---|---|---|---|
| Ni | Bal. | Bal. | Bal. |
| Cr | 15.6 | 14.9 | 15.2 |
| Mo | 15.6 | 15.6 | 15.3 |
| C | 0.004 | 0.02 | 0.06 |
| La | 0.09 | 0.12 | 0.12 |

TABLE VIII-continued

| | Alloy 101 | Alloy 102 | Alloy 103 |
|---|---|---|---|
| Si | <.01 | .12 | 0.39 |
| Mn | .24 | .24 | 0.29 |
| B | <.001 | <.001 | .002 |
| Co | <.05 | <.05 | <.05 |
| Fe | .1 | .1 | .1 |
| W | <.1 | <.1 | <.1 |
| P | <.01 | <.01 | <.01 |
| S | <.01 | <.01 | <.01 |
| Al | .18 | .18 | .28 |

Each of these alloys was formed into tensile bars and tested in the as cast and cast and aged condition. The results are set out in Tables IX, X and XI.

These data show that increasing carbon contents also cause degradation of as cast ultimate strength and both room temperature ductility of the alloy in the aged condition. Therefore, in the preferred embodiments of this invention carbon content is recommended to be about 0.02 wt% or less.

TABLE IX

TENSILE PROPERTIES OF BAR PRODUCED FROM ALLOY 101 (Nominal Composition, in w/o, Ni - 15.6 Cr-15.6 Mo - 0.004 C - 0.09 La)

| Test No. | Material Condition | Test Temp. (° F.) | 0.2% Yield Strength (ksi) | Ultimate Strength (ksi) | Elong. (%) |
|---|---|---|---|---|---|
| 1 | As - Cast | RT | 39.8 | 88.9 | 63.6 |
| 2 | " | " | 38.2 | 84.2 | 64.8 |
| 3 | " | 1400 | 21.1 | 37.1 | 23.4 |
| 4 | " | " | 22.4 | 37.0 | 19.4 |
| 5 | " | 1700 | 21.6 | 22.8 | 4.5 |
| 6 | " | " | 19.6 | 26.5 | 7.2 |
| 7 | " | 2000 | 9.9 | 10.2 | 6.6 |
| 8 | " | " | 9.2 | 9.3 | 10.4 |
| 9 | As-Cast + | RT | 37.3 | 87.1 | 67.8 |
| 10 | 1600° F./100 hrs/ AC | " | 36.1 | 90.0 | 71.0 |
| 11 | As-Cast + | " | 36.9 | 85.7 | 63.1 |
| 12 | 1600° F./479 hrs/ AC | " | 37.7 | 85.4 | 64.3 |

TABLE X

TENSILE PROPERTIES OF BAR PRODUCED FROM ALLOY 102 (Nominal Composition, in w/o, Ni - 14.9 Cr 15.6 Mo - 0.02 C - 0.12 La)

| Test No. | Material Condition | Test Temp. (° F) | 0.2% Yield Strength (ksi) | Ultimate Strength (ksi) | Elong. (%) |
|---|---|---|---|---|---|
| 1 | As - Cast | RT | 44.1 | 81.2 | 33.8 |
| 2 | " | " | 42.4 | 80.9 | 36.2 |
| 3 | " | 1400 | 26.2 | 50.3 | 24.2 |
| 4 | " | " | 27.0 | 48.3 | 26.5 |
| 5 | " | 1700 | 25.8 | 26.7 | 14.2 |
| 6 | " | " | 26.2 | 27.2 | 12.4 |
| 7 | " | 2000 | 9.5 | 9.6 | 9.6 |
| 8 | " | " | 9.6 | 9.8 | 7.1 |
| 9 | As-CAst + | RT | 43.1 | 88.4 | 29.5 |
| 10 | 1600° F./100 hrs/ | " | 42.3 | 90.1 | 36.9 |
| 11 | As-Cast + | " | 41.9 | 92.0 | 39.9 |
| 12 | 1600° F./479 hrs/ | " | 42.0 | 96.5 | 36.0 |

TABLE XI

TENSILE PROPERTIES OF BAR AND SHEET PRODUCED FROM ALLOY 013 (Nominal Composition, in w/o, Ni - 15.2 Cr - 15.3 Mo - 0.06 C - 0.39 Si - 0.29 Mn - 0.12 La)

| Test No. | Material Condition Bar | Test Temp. (° F) | 0.2% Yield Strength (ksi) | Ultimate Strength (ksi) | Elong. (%) |
|---|---|---|---|---|---|
| 1 | As - Cast | RT | 45.8 | 65.4 | 10.4 |
| 2 | " | " | 47.4 | 73.9 | 17.0 |
| 3 | " | 1400 | 30.3 | 56.4 | 32.1 |
| 4 | " | " | 29.0 | 50.4 | 29.1 |

TABLE XI-continued

TENSILE PROPERTIES OF BAR AND SHEET PRODUCED FROM ALLOY 013 (Nominal Composition, in w/o, Ni - 15.2 Cr - 15.3 Mo - 0.06 C - 0.39 Si - 0.29 Mn - 0.12 La)

| Test No. | Material Condition Bar | Test Temp. (° F) | 0.2% Yield Strength (ksi) | Ultimate Strength (ksi) | Elong. (%) |
|---|---|---|---|---|---|
| 5 | " | 1700 | 26.0 | 26.1 | 31.0 |
| 6 | " | " | 24.3 | 24.9 | 35.2 |
| 7 | " | 2000 | 9.8 | 10.0 | 38.9 |
| 8 | " | " | 11.6 | 11.6 | 30.4 |
| 9 | As-Cast + | RT | 44.2 | 76.2 | 15.8 |
| 10 | 1600° F./100 hrs/ AC | " | 44.8 | 78.7 | 17.2 |
| 11 | As-Cast + | " | 44.3 | 74.6 | 13.5 |
| 12 | 1600° F./479 hrs/ AC | " | 43.6 | 81.3 | 15.8 |

While we have set out certain preferred practices and embodiments of our invention in the foregoing specification, it will be evident that this invention may be otherwise embodied within the scope of the following claims.

We claim:

1. A cast thermally stable high temperature alloy characterized by superior oxidation resistance, sustainable high hot strength and retention of ductility on aging consisting essentially by weight of:

Mo: 13.7% to 15.5%
Cr: 14.7% to 16.5%
C: Up to 0.1%
La: An effective amount to produce oxidation resistance up to 0.08%
B: Up to 0.015%
Mn: 0.3% to 1.0%
Si: 0.2% to 0.75%
Co: Up to 2.0%
Fe: Up to 3.0%
W: Up to 1.0%
Cu: Up to 0.35%
P: Up to 0.02%
S: Up to 0.015%
Al: 0.1% to 0.5%
Ni: Balance said alloy having an Nv number less than 2.31.

2. A cast alloy as claimed in claim 1 having up to 0.02% carbon.

3. A cast alloy as claimed in claim 1 wherein the composition consists essentially of:

Mo: about 14.0%
Cr: about 15.5%
C: LAP
La: about 0.04%
B: about 0.01%
Mn: about 0.5%
Si: about 0.4%
Co: LAP
Fe: LAP
W: LAP
Cu: LAP
P: LAP
S: LAP
Al: about 0.25%
Ni: Balance said alloy having an Nv number as close to 2.28 as possible but within the range 2.23 to 2.31.

4. A nickel base alloy casting made from an alloy consisting essentially of:

Mo: 13.7% to 15.5%

Cr: 14.7% to 16.5%
C: Up to 0.1%
La: An effective amount to produce oxidation resistance up to 0.08%
B: Up to 0.015%
Mn: 0.3% to 1.0%
Si: 0.2% to 0.75%
Co: Up to 2.0%
Fe: Up to 3.0%
W: Up to 1.0%
Cu: Up to 0.35%
P: Up to 0.02%
S: Up to 0.015%
Al: 0.1% to 0.5%
Ni: Balance
said alloy having an Nv number less than 2.31, said casting characterized by thermal stability resistance to oxidation at temperatures above 1600° F., sustainable hot strength and retention of ductility on aging.

5. A nickel base alloy casting as claimed in claim 4 having up to 0.02% carbon.

6. A nickel base alloy casting as claimed in claim 4 made from an alloy consisting essentially of:
Mo: about 14.0%
Cr: about 15.5%
C: LAP
La: about 0.04%
B: about 0.01%
Mn: about 0.5%
Si: about 0.4%
Co: LAP
Fe: LAP
W: LAP
Cu: LAP
P: LAP
S: LAP
Al: about 0.25%
Ni: Balance
said alloy having an Nv number as close to 2.28 as possible but within the range 2.23 to 2.31.

* * * * *

UNITED STATES PATENT OFFICE

CERTIFICATE OF CORRECTION

Patent No. 4,043,810 Dated August 23, 1977

Inventor(s) DENNIS S. ACUNCIUS et al.

It is certified that error appears in the above-identified patent and that said Letters Patent are hereby corrected as shown below:

In the Abstract, line 9, "0.8" should read --0.8%--.

Column 3, Table I, for the Element "Cr", Mold #1, "15.5" should read --15.55--.

Column 6, Table V, "CATINGS" should read --CASTINGS--.

Column 7, Table VI, line 45, under the heading V/A Pin Diam. (2) (Inches) "2.99" should read --.299--.

Column 9, Table X, under the heading "Material Condition", Test No. 10, after "1600°F./100 hrs/" should read --AC--.

Column 9, Table X, under the heading "Material Condition", Test No. 12, after "1600°F./479 hrs/" should read --AC--.

Column 9, Table XI, "013" should read --103--.

Column 10, Table XI-continued, "013" should read --103--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*